United States Patent [19]

Rosenström

[11] Patent Number: 4,573,504

[45] Date of Patent: Mar. 4, 1986

[54] EQUIPMENT FOR THE REMOVAL OF AIR OUT OF PULVERULENT MATERIALS

[75] Inventor: Pertti Rosenström, Kyminlinna, Finland

[73] Assignee: Erkomat Oy, Kotka, Finland

[21] Appl. No.: 609,130

[22] Filed: May 11, 1984

[30] Foreign Application Priority Data

May 11, 1983 [FI] Finland ..... 831654

[51] Int. Cl.[4] ..... B65B 1/04

[52] U.S. Cl. ..... 141/59; 141/302; 222/636; 406/25; 406/30; 406/109

[58] Field of Search ..... 406/29, 30, 109; 222/636; 141/1-12, 37-68, 270-284, 285-310

[56] References Cited

U.S. PATENT DOCUMENTS 3,716,082 2/1973 Green ..... 141/286

3,799,622 3/1974 Hek ..... 406/109

*Primary Examiner*—Houston S. Bell, Jr.

*Attorney, Agent, or Firm*—Burns, Doane, Swecker & Mathis

[57] ABSTRACT

Equipment for the removal of air out of pulverulent materials before the product is packaged or transferred. The equipment comprises a storage silo (1), out of which the pulverulent material to be packaged flows readily into the packaging vessel placed underneath. At a distance from the tight exterior wall (8) of the packaging vessel, there is a metallic porous face of lining material (9), through which it is possible to remove air out of the packaging vessel or to feed pressurized air into the packaging vessel through the space between the exterior wall of the packaging vessel and the said porous face of lining material. The space between the exterior wall of the packaging vessel and the face of lining material is divided air-tightly, in the direction of progress of the pulverulent material, by means of partition walls, into at least two, preferably three, four or five compartments (3 to 7) separate from each other. A suction or pressure of desired magnitude is arranged as connectable to each of the said compartments independently from each other.

4 Claims, 11 Drawing Figures

EQUIPMENT FOR THE REMOVAL OF AIR OUT OF PULVERULENT MATERIALS

The present invention is concerned with equipment for the removal of air out of pulverulent materials before the product of packaged or transferred, whereat the said equipment comprises a storage container, such as, e.g., a storage silo, out of which the pulverulent material to be packaged flows readily into the packaging vessel placed underneath, inside of which, at a distance from the tight exterior wall of the packaging vessel, substantially over the entire length of the packaging vessel, there is a porous face of lining material, through which it is possible to remove air out of the packaging vessel or to feed pressurized air into the packaging vessel through the space between the exterior wall of the packaging vessel and the said porous face of lining material.

In prior art, various methods are known for the packaging of pulverulent or granular material into vacuum packages.

The equipment in accordance with the present invention is characterized in that the space between the exterior wall of the packaging vessel and the face of lining material is divided air-tightly, in the direction of progress of the pulverulent material, by means of partition walls, into at least two, preferably three, four or five compartments separate from each other, a suction or pressure of desired magnitude being arranged as connectable to each of the said compartments independently from each other.

The equipment can be used for the treatment of pulverulent and readily aerated materials. The equipment may constitute, e.g., the packaging chamber of a valve sacking machine, whereat, for the material concerned, it is possible to reduce the sack size and to facilitate the subsequent handling of the packages, which maintain their shape better.

Figure 1:
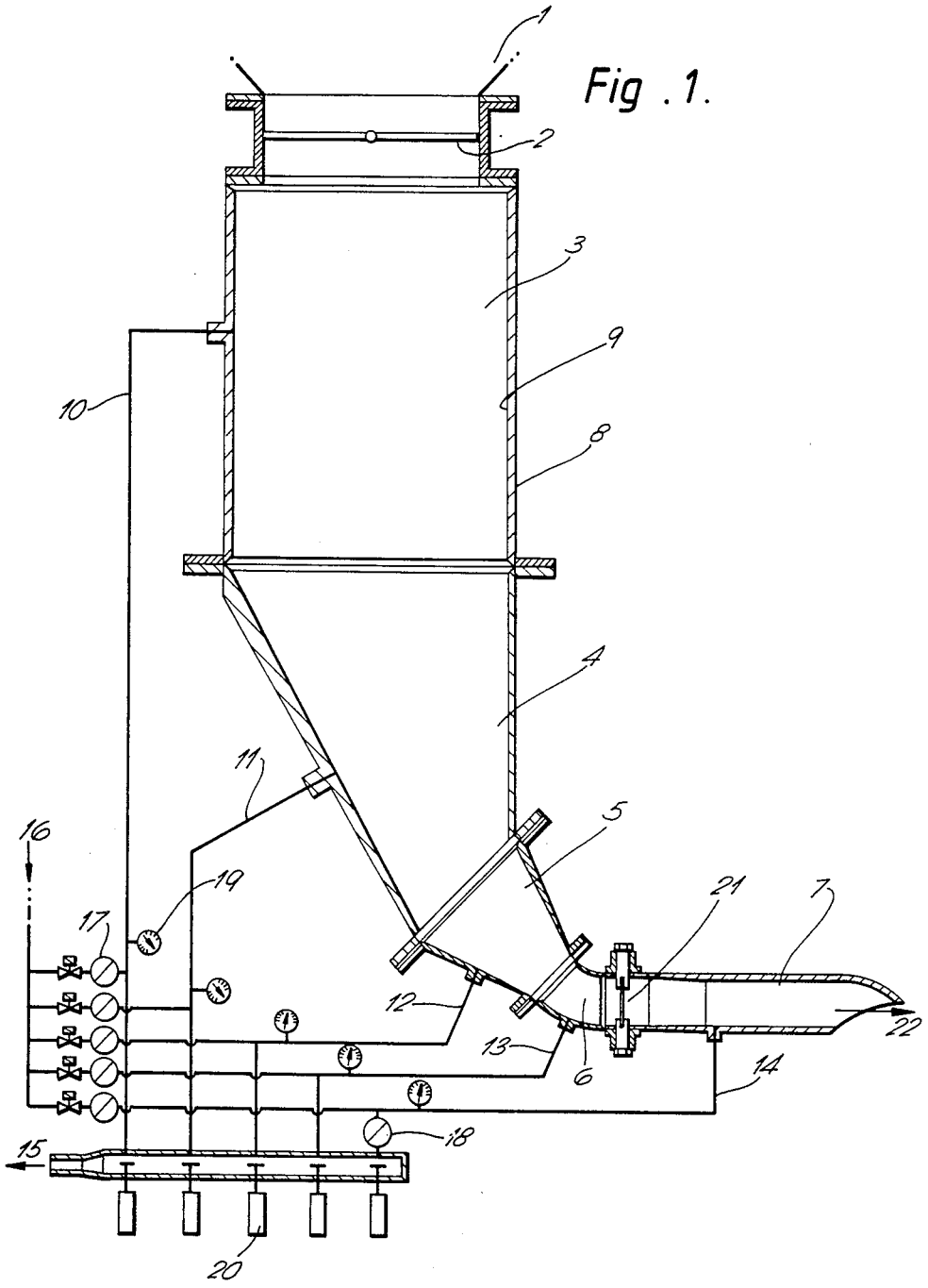

The invention will be described in more detail in the following with reference to the attached drawings, wherein FIG. 1 shows the construction of an equipment in accordance with the invention, and FIGS. 2 to 11 show different stages of operation of the equipment in accordance with the invention.

The equipment in accordance with the invention is connected to the lower end of the storage silo 1 by the intermediate of a closing valve 2. The equipment comprises five packaging compartments 3 to 7 one after the other. The compartments constitute one unified space. Inside the tight exterior wall 8 of the equipment, there is a porous metallic lining sheet 9, placed at a specified distance from the exterior wall. The equipment is constructed in such a way that the distance between the exterior wall and the porous sheet is maintained even if air is sucked off out of the space between the wall and the lining. The density of the porous sheet is in such a way optimized that the product to be packaged does not flow through the lining. Only the air or gas contained in the product passes through the sheet. The space between the exterior wall 8 and the lining material 9 is, at each packaging compartment, divided into separate compartments by means of air-tight partition walls.

Each packaging compartment is connected with a pipe 10 to 14, which is connected both to a source of vacuum 15 and to a source of compressed air 16. The pipe system is provided with five pressure regulating valves 17, one at each branch next to the pressure source, and with a pressure regulating valve 18 at the branch next to the vacuum source. Each pipe 10 to 14 is provided with a pressure gauge 19. The vacuum source is provided with five suction valves 20, connected to the branches related to each of the pipes 10 to 14.

The lowermost packaging compartment 6 is connected by means of the closing valve 21 to the horizontal outlet pipe 7, from which the material to be packaged is removed at 22. The cross-section of the packaging compartments becomes smaller towards the outlet end of the equipment.

In the following, the operation of the equipment will be described with reference to FIGS. 2 to 11. In these figures, the material to be packaged is denoted with grey colour, and the condensed portion with darker grey. Each valve 17 is shown as fully black when it is open and with mere contours when it is closed. Likewise, the suction valves 20 are shown as being either open or closed.

Figure 2:
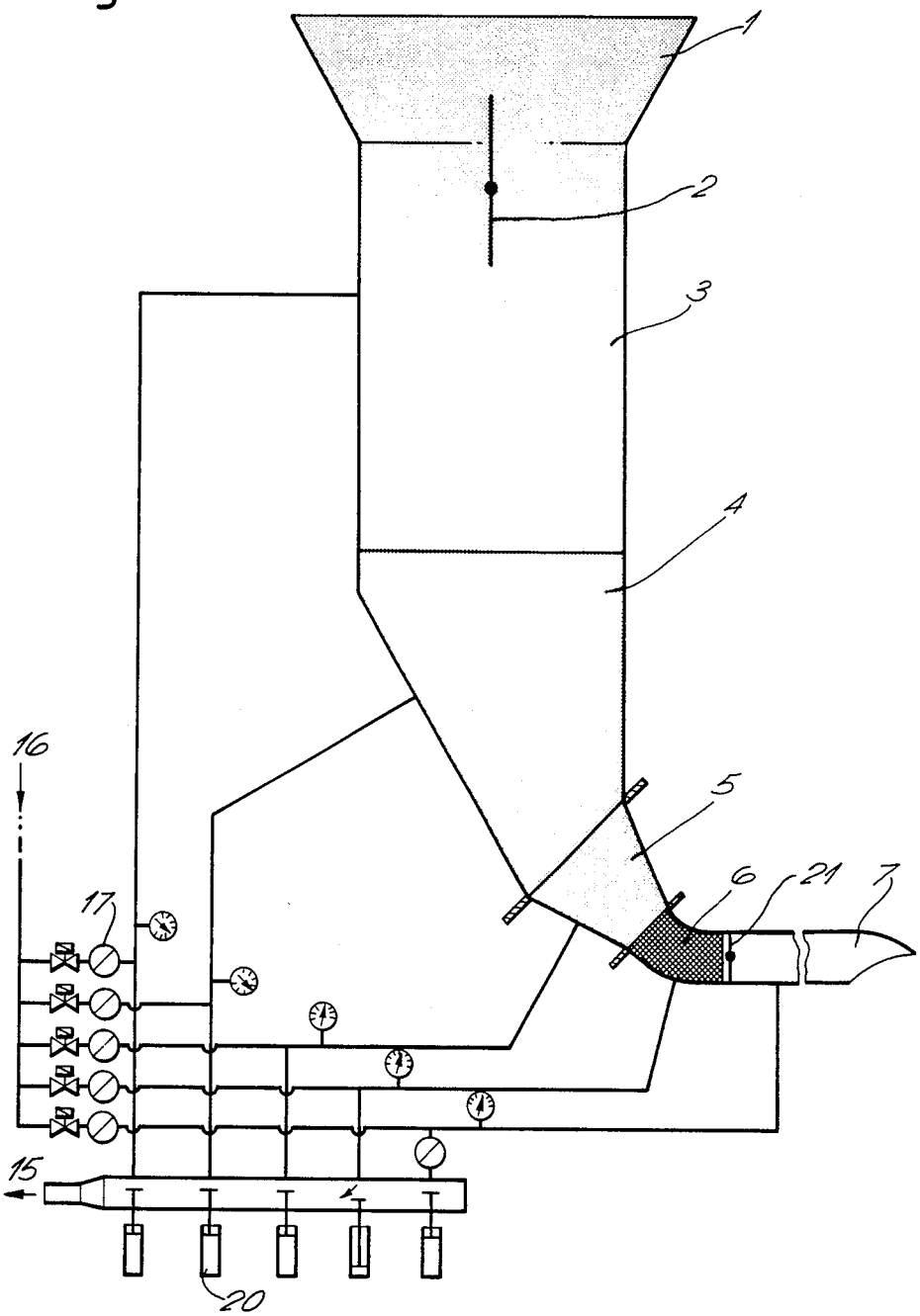

In FIG. 2, the closing valve of the upper chamber has just been opened and the packaging compartments have been filled with the material flowing down from the silo 1. The flowing down has been aided by vacuum guided into the packaging compartment 6, owing to which the material to be treated does not have to displace the quantity of air that would possibly be otherwise present in the packaging compartments. By directing the effect of the vacuum first at the compartment 6, the filling degree in the said compartment can be made as high as possible, and the condensing effect efficient.

Figure 3:
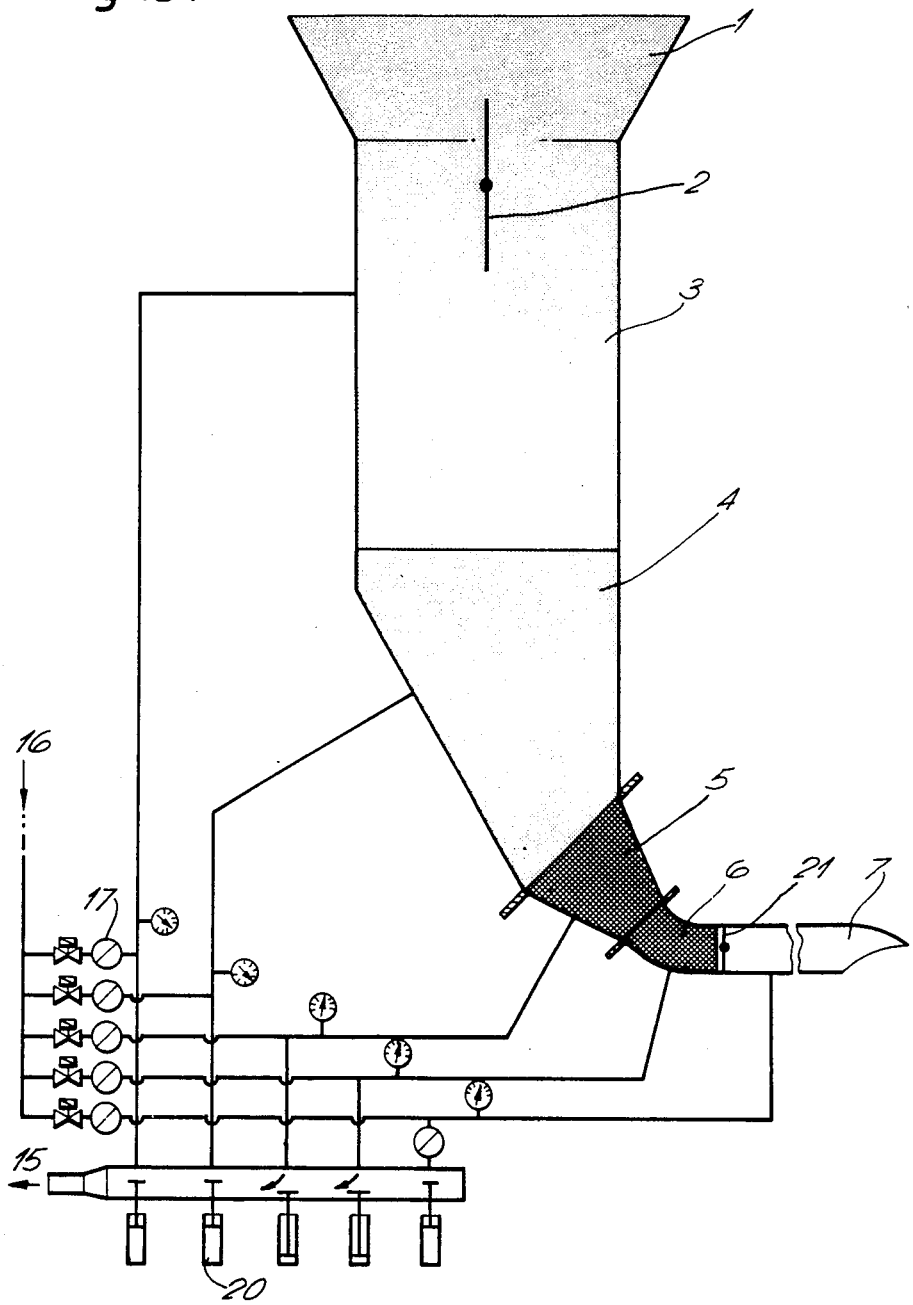

In the stage shown in FIG. 3, condensing has taken place in chamber 6, and the effect of vacuum has been directed at the next chamber 5.

Figure 4:
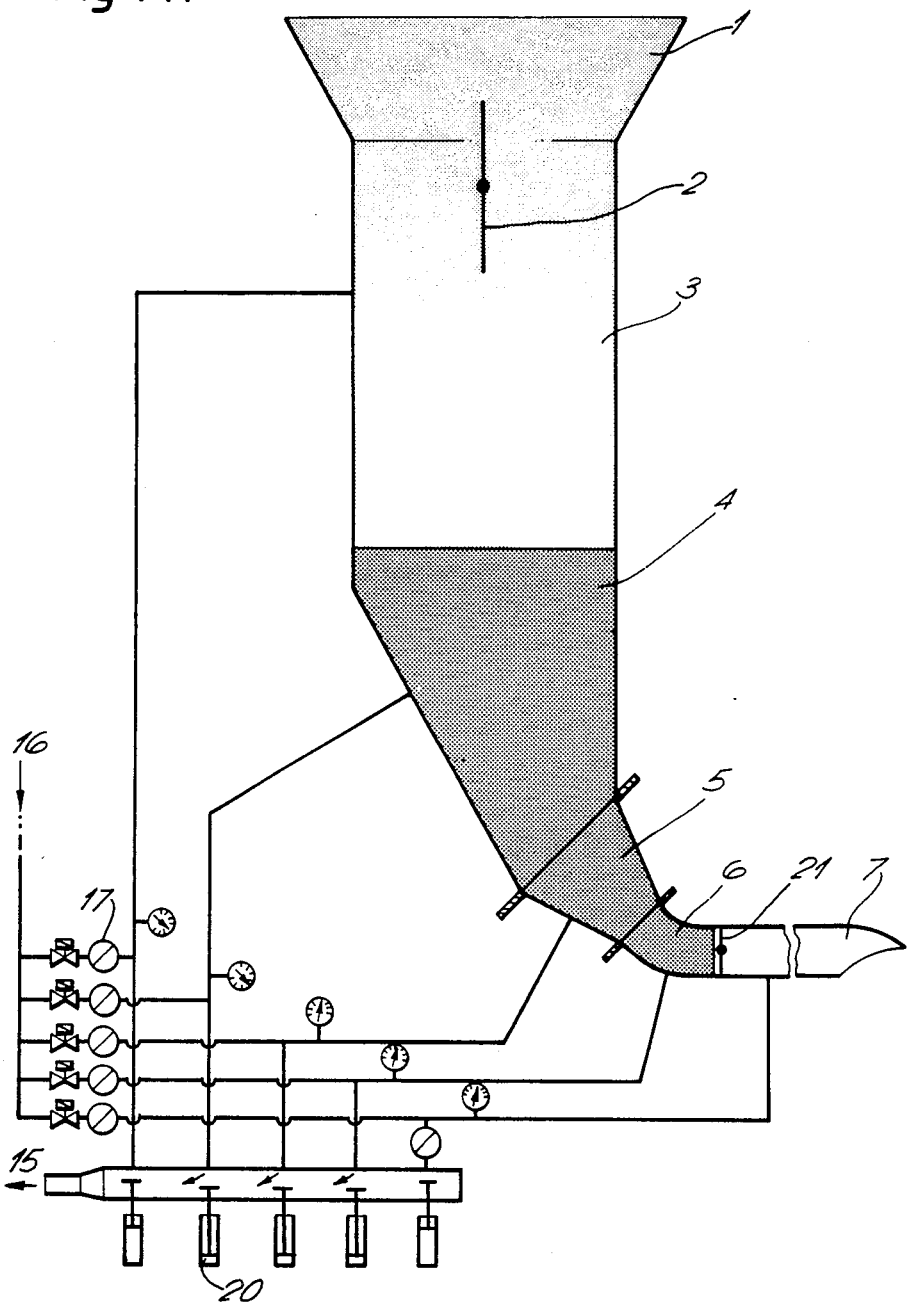

Correspondingly, in the following stage of FIG. 4, the effect of vacuum is directed at chamber 4.

Figure 5:
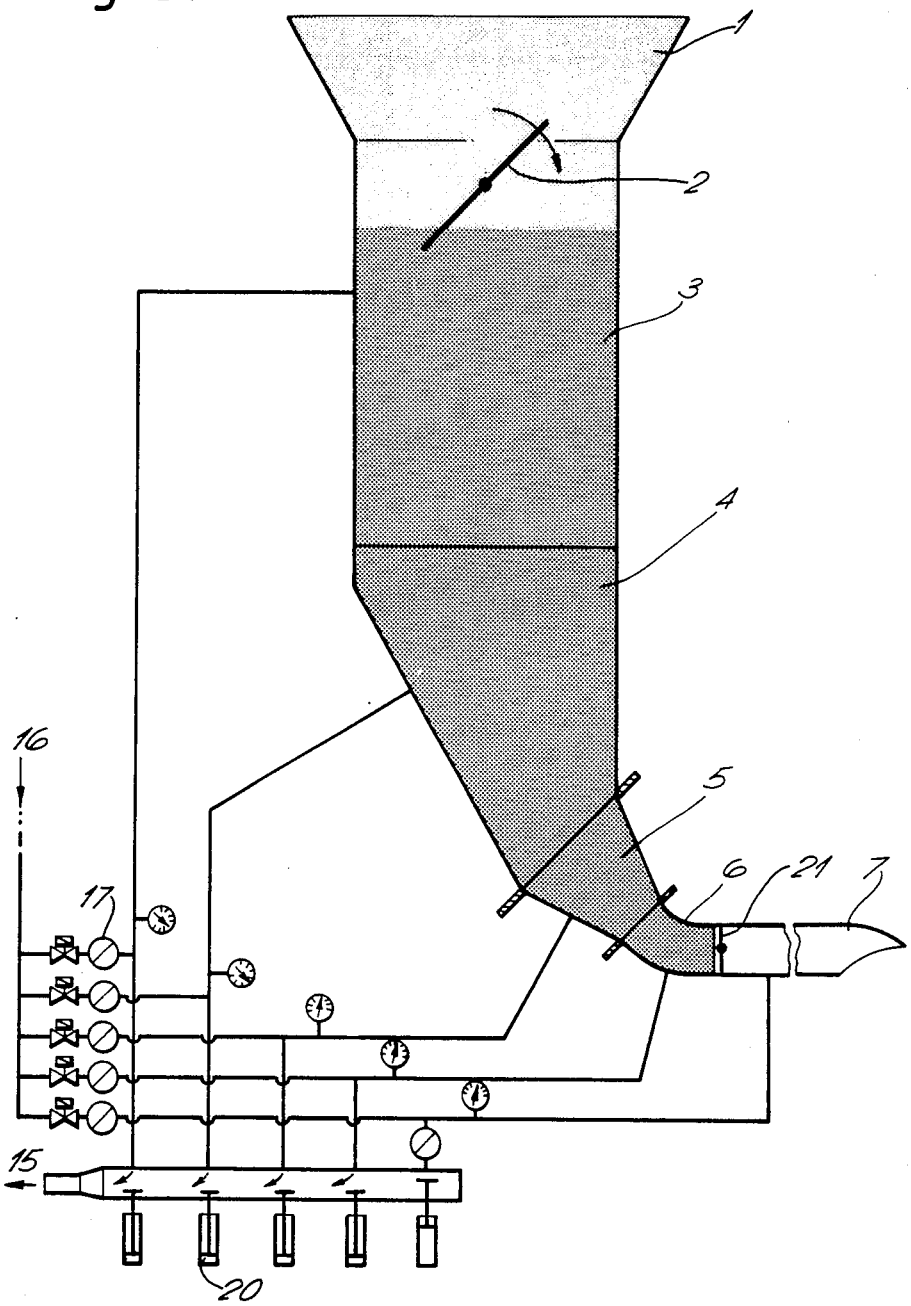

In FIG. 5, the effect of vacuum has been extended to chamber 3. After an appropriate period of time, the top valve 2 is closed.

Figure 6:
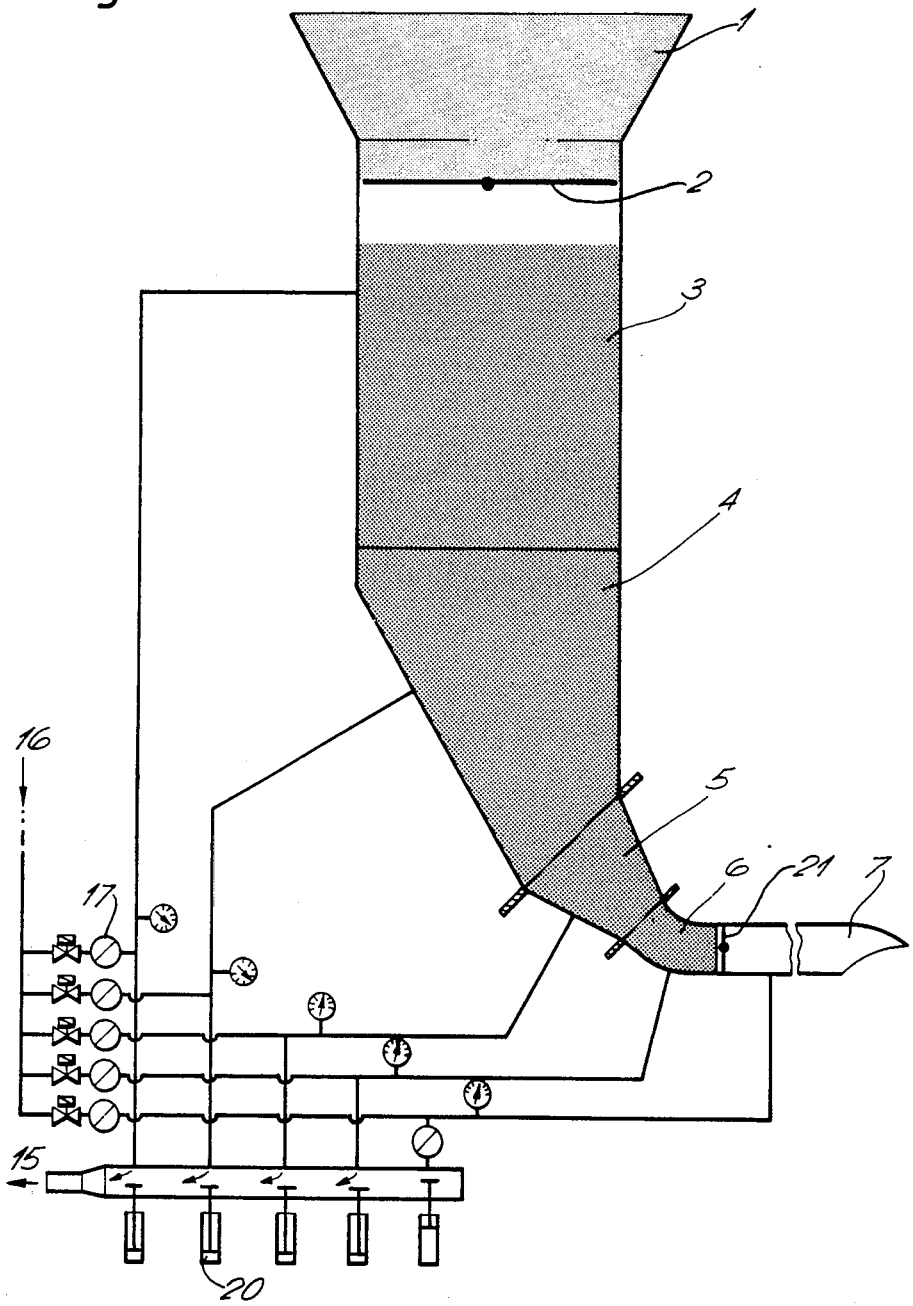

In the situation shown in FIG. 6, the condensing effect is intensified by allowing the vacuum to act upon all of the packaging compartments simultaneously, at the same time as the valves 2 and 21 are closed. The degree of condensing can be adjusted by varying the vacuum and the time used.

Figure 7:
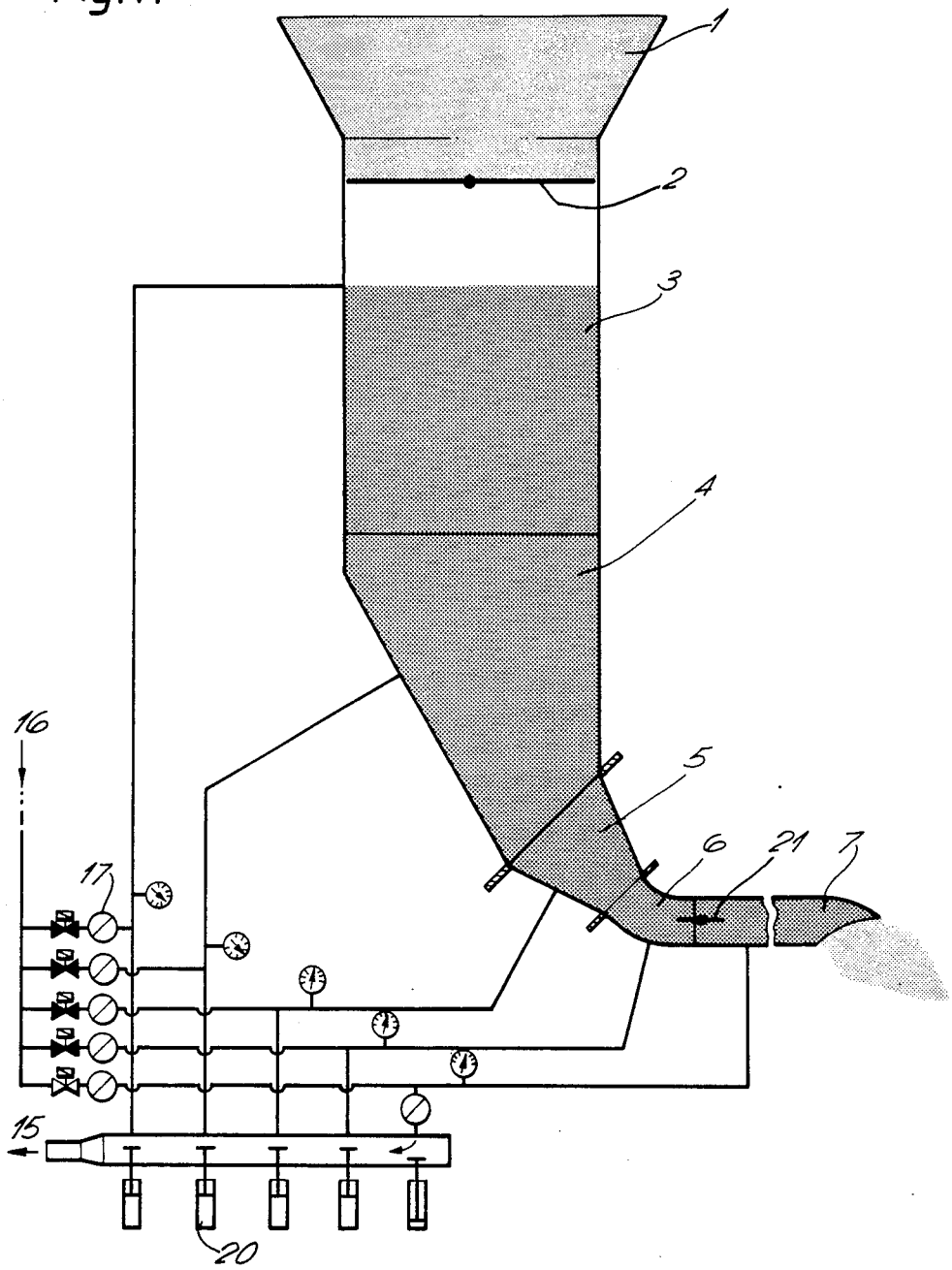

In FIG. 7, the bottom valve 21 has been opened and the pressure to be directed at the packaging compartments, appropriately adjusted for each of the packaging compartments separately by means of the regulating valves, forces the condensed material to attempt to flow out through the bottom valve. The air guided into the packaging compartments under pressure passes through the porous lining material 9 and forms a layer that reduces the friction between the material to be treated and the porous face. By means of the narrowing cross-sectional area of the packaging compartments, the laminar flow of the material flow as well as the maintenance of the properties of the condensed product are intensified.

By means of an appropriate vacuum or pressure directed at the packaging compartment 7, the movement and the condensing effect of the material flow are controlled.

Figure 8:
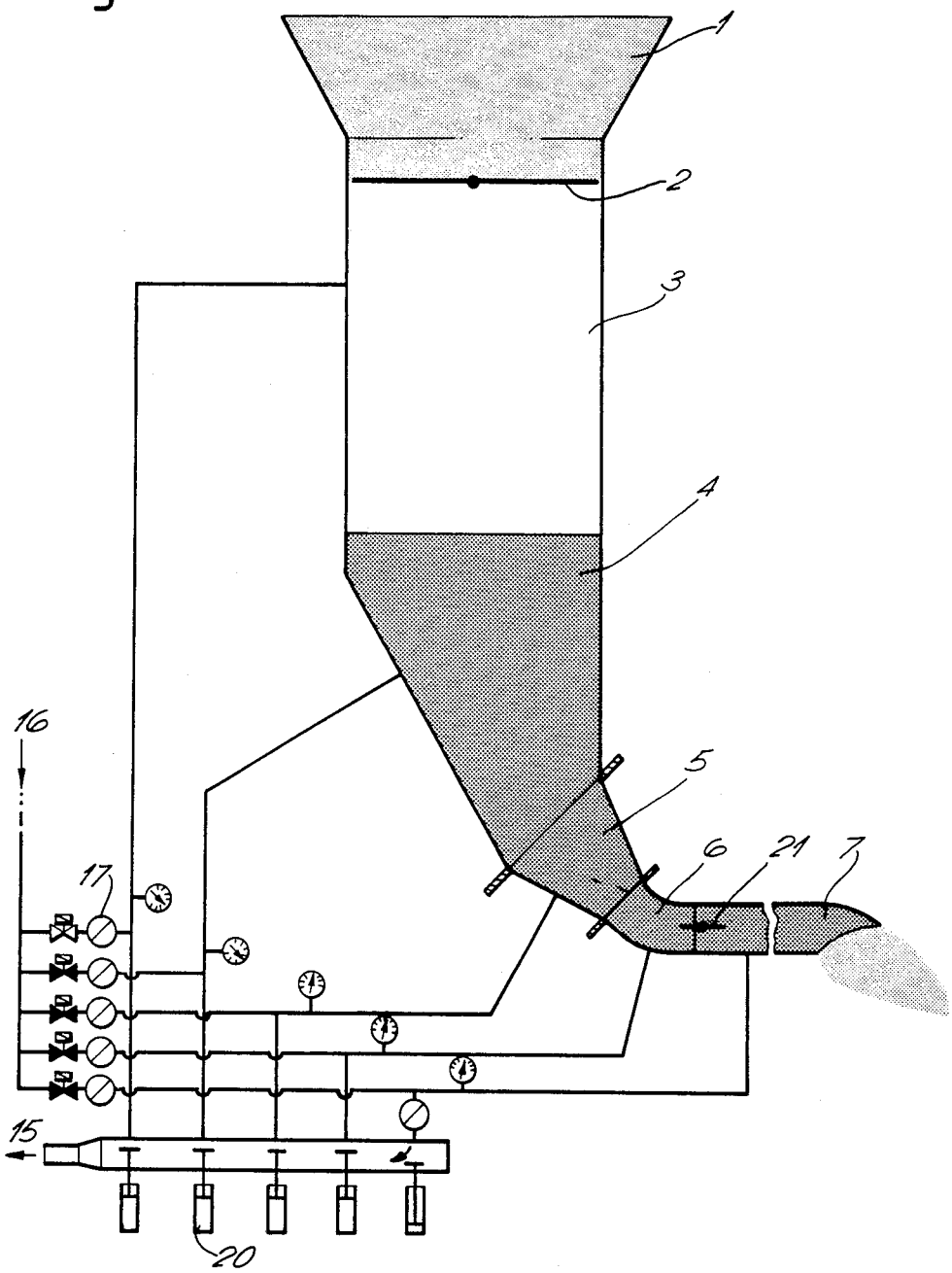

In the stage shown in FIG. 8, some of the material has moved out of the packaging compartments. After the compartment 3 has been emptied, the supply of compressed air can be discontinued in respect of that compartment, whereat the quantity of compressed air used is as little as possible and controlled in such a way that the effect of eliminating the friction is as high as possible.

Figure 9:
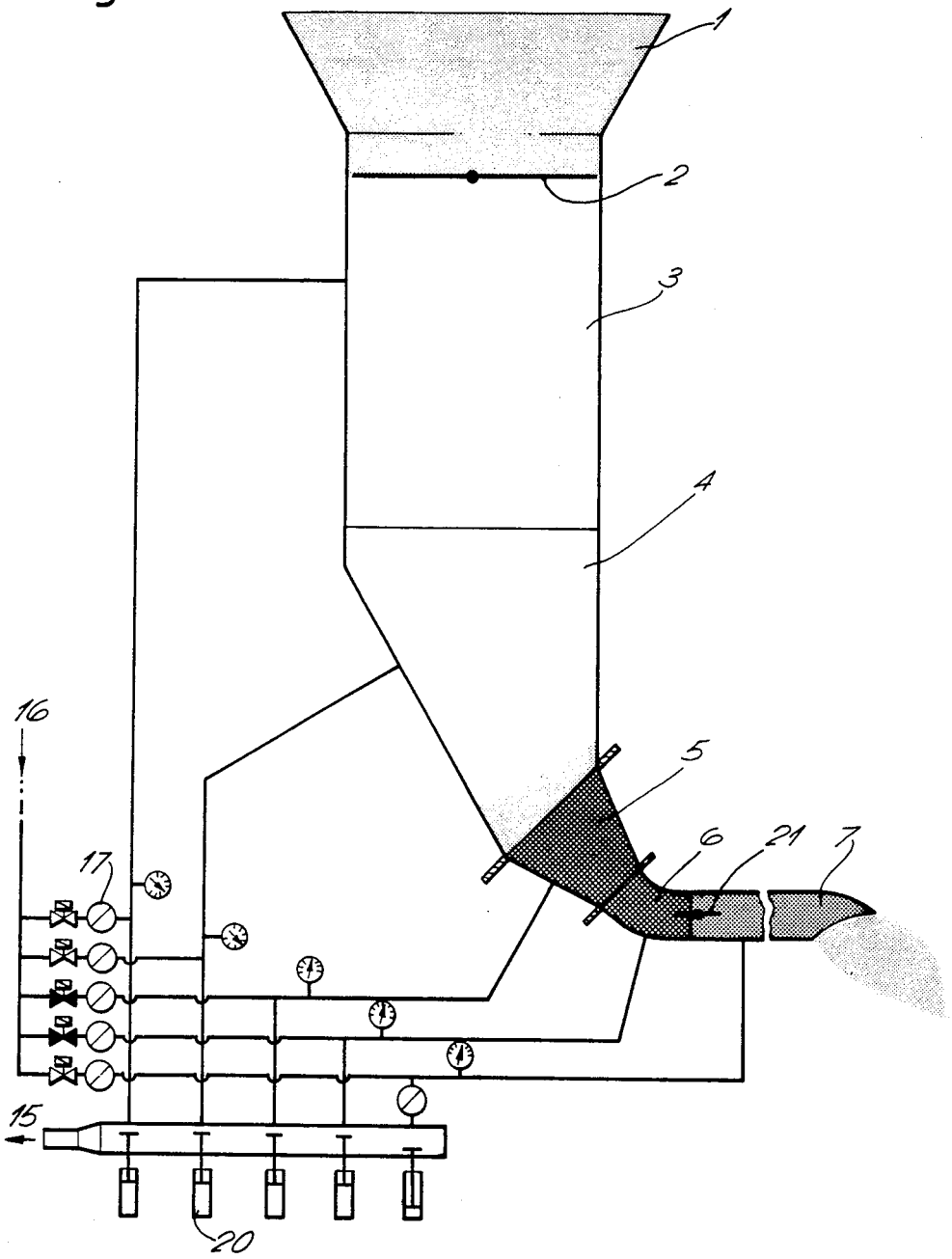

The situation shown in FIG. 9 corresponds to that shown in FIG. 8. A deposit corresponding to the original uncondensed material starts being formed in the packaging compartment.

Figure 10:
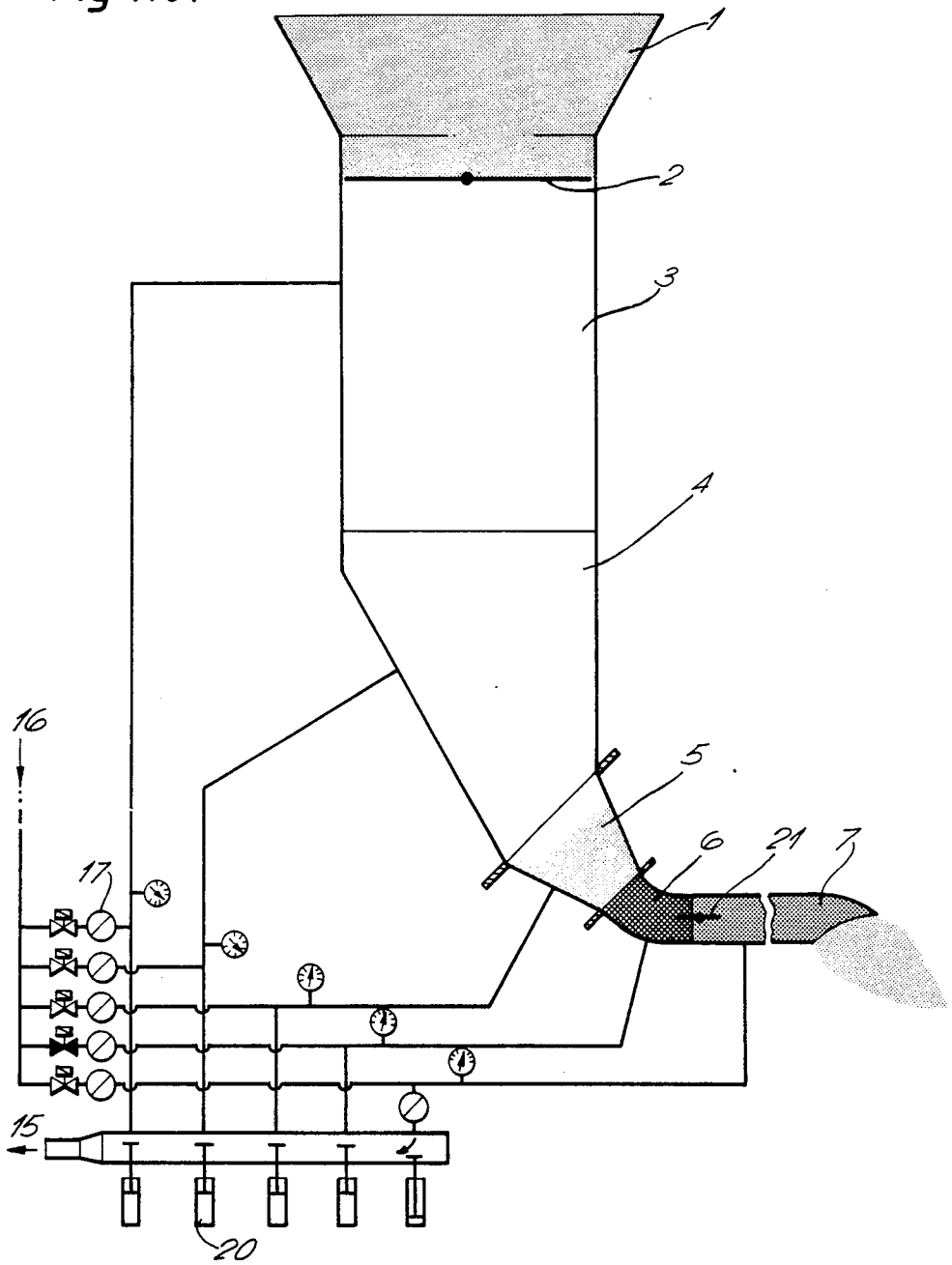

The situation shown in FIG. 10 is similar to that shown in the preceding figure.

Figure 11:
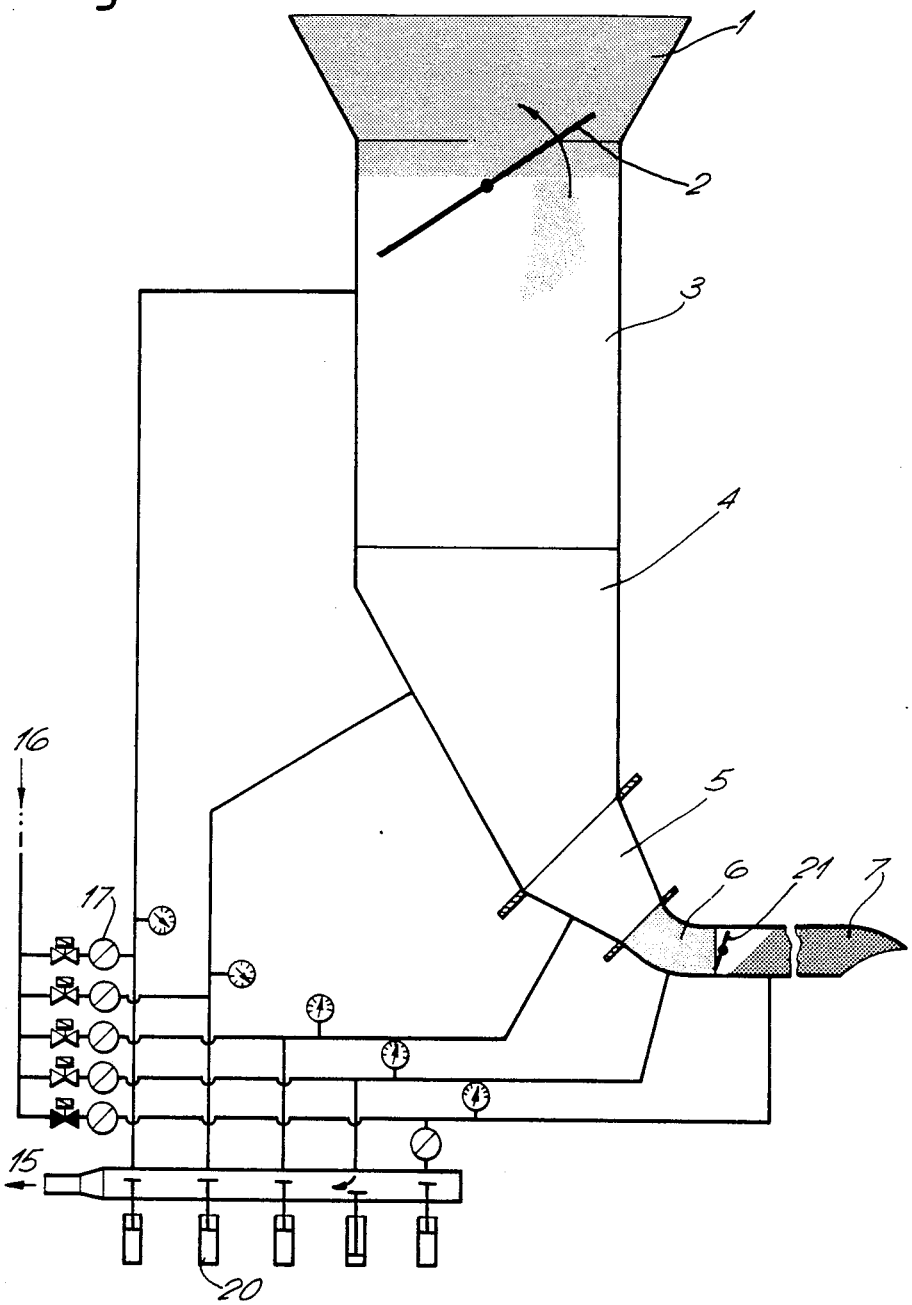

In FIG. 11, the top valve 2 is opened, whereat the material in the storage silo 1 starts flowing into the compartment 3. At the same time, the valve has been closed, and the vacuum is directed at the bottommost packaging compartment 6, whereat the material aerated at the final stage of the emptying can be condensed again. If necessary, the compartment 7 is emptied by applying positive pressure to the compartment.

The equipment may also be a so-called pressure transmitter, whereat the guiding of the condensed material into the transfer pipe can be controlled easily.

Several sets of equipment may be connected in parallel in order to increase the capacity or in series in order to improve the condensing effect.

What is claimed is:

1. Equipment for the removal of air from pulverulent materials before the product is packaged or transferred, said equipment comprising a storage container out of which the pulverulent material to be packaged flows readily into a packaging vessel placed underneath, a porous face of lining material being provided at a distance from a gas tight exterior wall of the packaging vessel substantially over the entire length of the packaging vessel, said lining material, permitting either removal of air from the packaging vessel or feeding pressurized air into the packaging vessel through the space between the exterior wall of the packaging vessel and said porous face of the lining material the space between the exterior wall of the packaging vessel and the face of the lining material being divided air-tightly, in the direction of progress of the pulverulent material, by partition walls into at least two compartments separate from each other, means for individually, selectively connecting a suction or a pressure of a desired magnitude to each of said compartments independently from each other.

2. Equipment as claimed in claim 1, characterized in that the cross-sectional area of the packaging vessel is, in the direction of progress of the pulverulent material, all the time narrowing.

3. Equipment as claimed in claim 1, wherein the pulverulent material is removed from the bottom part of the packaging vessel through a substantially horizontal outlet pipe.

4. Equipment as claimed in claim 2, wherein the pulverulent material is removed from the bottom part of the downwardly narrowing packaging vessel through a substantially horizontal outlet pipe.

* * * * *